United States Patent [19]

Granata, Jr. et al.

[11] Patent Number: 4,576,222

[45] Date of Patent: Mar. 18, 1986

[54] FLUID DISTRIBUTOR FOR HEAT EXCHANGER INLET NOZZLE

[75] Inventors: Samuel J. Granata, Jr., Greensburg; John A. Rylatt, Monroeville, both of Pa.

[73] Assignee: Westinghouse Electric Corp., Pittsburgh, Pa.

[21] Appl. No.: 413,584

[22] Filed: Aug. 31, 1982

[51] Int. Cl.[4] ..... F28F 7/00; F28F 9/22; F28D 7/00

[52] U.S. Cl. ..... 165/76; 165/159; 165/134.1

[58] Field of Search ..... 165/109, 173, 174, 134 R, 165/DIG. 11, 161, 162, 159, 160, 110, 111, 114, 76; 122/34, 441; 137/561 A, 262, 592

[56] References Cited

U.S. PATENT DOCUMENTS

| | | | |
|---|---|---|---|
| 2,830,797 | 4/1958 | Garland | 165/110 |
| 3,042,379 | 7/1962 | Hinde | 165/134 R |
| 3,070,157 | 12/1962 | Droescher | 165/159 |
| 3,139,926 | 7/1964 | Tinker | 165/111 |
| 3,361,196 | 1/1968 | Aoyama | 165/174 |
| 3,382,918 | 5/1968 | Stoker et al. | 165/111 |
| 3,538,983 | 11/1970 | Thomae | 165/110 |
| 3,712,370 | 1/1973 | Gilli et al. | 165/161 |
| 3,827,484 | 8/1974 | Wolowodiuk | 122/32 |
| 4,016,835 | 4/1977 | Yarden et al. | 165/159 |
| 4,166,497 | 9/1979 | Coit | 165/111 |
| 4,254,825 | 3/1981 | Imazu | 165/134 R |
| 4,307,685 | 12/1981 | Robin et al. | 165/134 R |

FOREIGN PATENT DOCUMENTS

| | | | |
|---|---|---|---|
| 2605186 | 8/1977 | Fed. Rep. of Germany | 165/134 R |
| 1583744 | 12/1969 | France | 165/159 |
| 0052009 | 4/1977 | Japan | 165/159 |
| 0134724 | 3/1952 | Sweden | 165/159 |
| 0027198 | of 1897 | United Kingdom | 165/159 |
| 0777391 | 11/1980 | U.S.S.R. | 165/159 |

*Primary Examiner*—William R. Cline
*Assistant Examiner*—John K. Ford
*Attorney, Agent, or Firm*—F. J. Baehr, Jr.

[57] ABSTRACT

An inlet flow distributor comprising multiple chambers and a flow splitter which can be freely inserted through the feedwater inlet nozzle and assembled and attached to the nozzle in such a manner that each chamber receives a portion of the influent feedwater and distributes it at controlled peak velocities and in a predetermined pattern to the shell through a pair of perforated plates having offset perforations in order to reduce vibration of tubes adjacent thereto.

8 Claims, 5 Drawing Figures

FLUID DISTRIBUTOR FOR HEAT EXCHANGER INLET NOZZLE

BACKGROUND OF THE INVENTION

This invention relates to heat exchangers and more particularly to a flow distributor for the inlet nozzle of a shell and tube heat exchanger.

Tube vibrations have been detected adjacent the inlet nozzle in shell and tube heat exchangers, such as steam generators. The vibration has a potential of producing localized tube-wall thinning at the juncture of the tube and support plate.

Even though impingement plates are disposed adjacent the inlet nozzle, turbulent flow is produced in this region and therefore tube vibration.

SUMMARY OF THE INVENTION

A flow distributor for an inlet nozzle of a shell and tube heat exchanger when made in accordance with this invention comprises a plurality of vanes disposed in the inlet nozzle so as to form a plurality of separate fluid paths, a plurality of enclosures disposed within the shell and connected to the vanes so that each separate fluid path is in communication with an enclosure, and each enclosure having a plurality of apertures in fluid communication with the shell portion of the heat exchanger.

BRIEF DESCRIPTION OF THE DRAWINGS

The object and advantages of this invention will become more apparent from reading the following detailed description in conjunction with the accompanying drawings, in which.

DESCRIPTION OF THE PREFERRED EMBODIMENT

Figure 1:
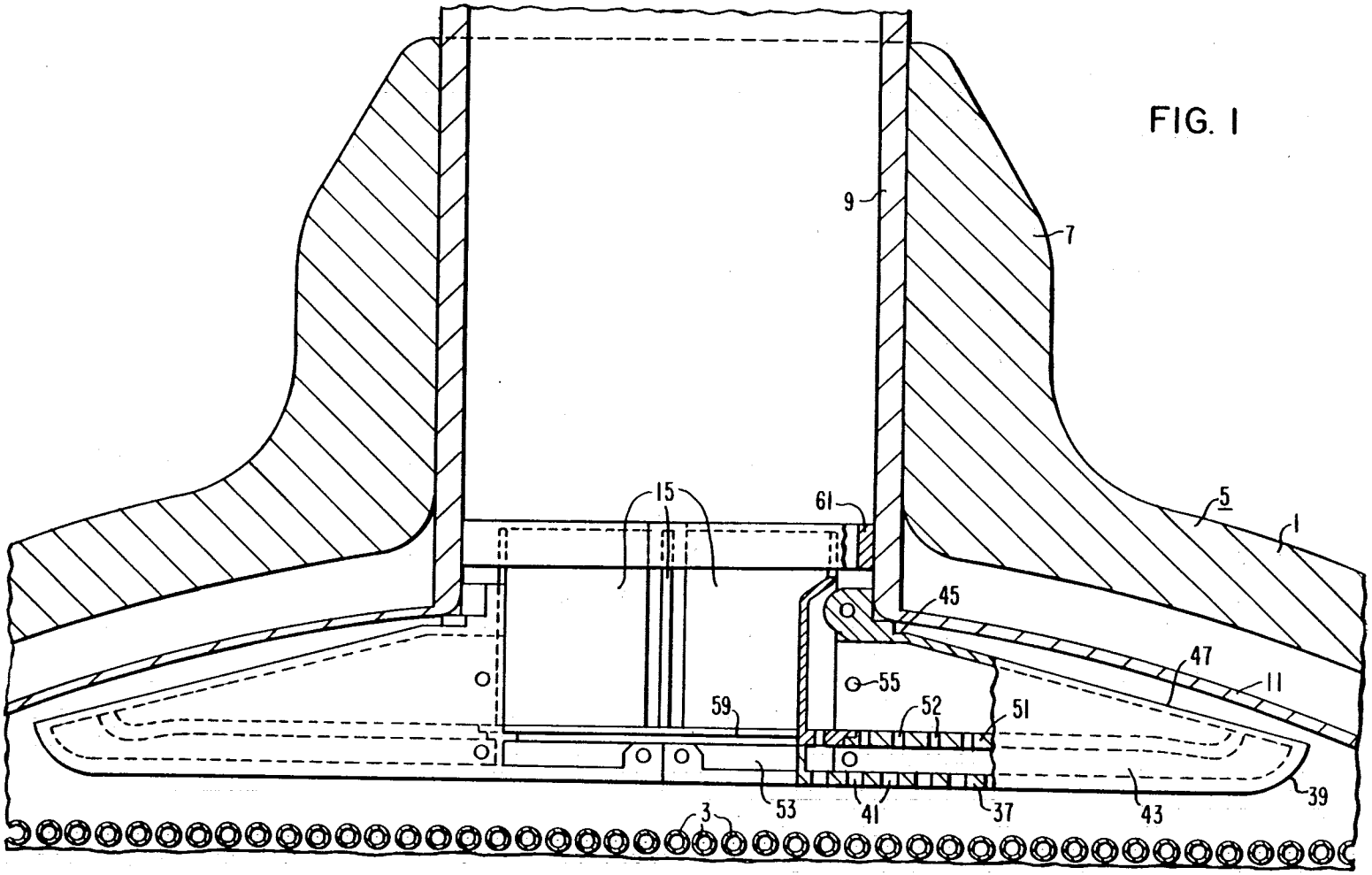
FIG. 1 is a partial sectional view of a heat exchanger showing a flow distributor disposed in the inlet nozzle.

Referring now to the drawings in detail and in particular to FIG. 1 there is shown a portion of a shell 1 and tube 3 heat exchanger 5 with an inlet nozzle 7 extending from the shell 1. The nozzle 7 has a thermal lining 9, which extends to a wrapper 11 disposed between the shell 1 and the tubes 3.

Figure 2:
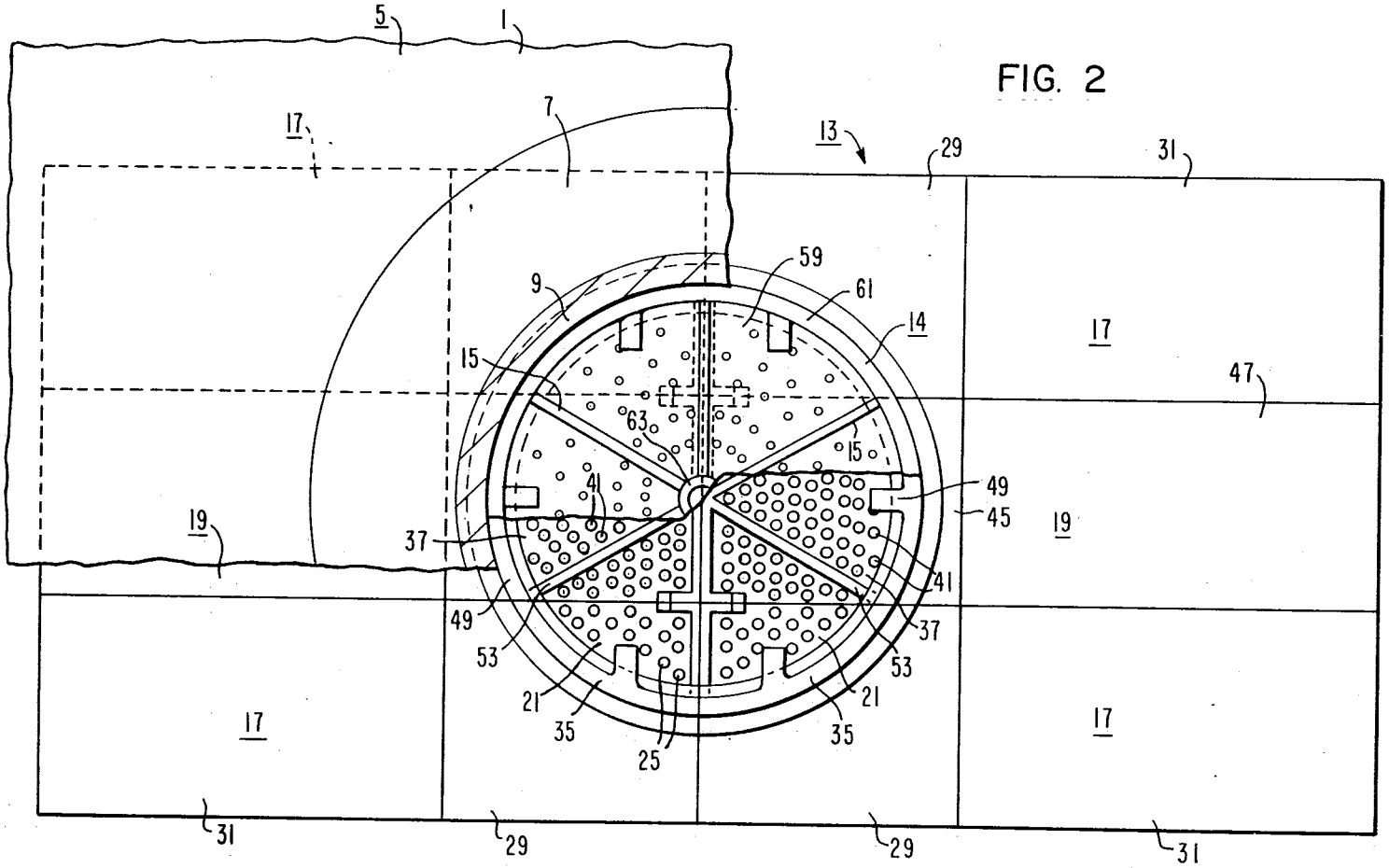
FIG. 2 is an elevational view of the flow distributor.

In fluid communication with the shell side of the heat exchanger 5 and the inlet nozzle 7 is a flow distributor 13. The flow distributor 13 as shown in FIG. 2 comprises a flow splitter portion 14 with a plurality of vanes 15 that extend radially from the axis of the inlet nozzle 7 to form a plurality, six, individual pie-shaped flow paths parallel with the flow path in the inlet nozzle and a plurality, six, enclosures or chambers each of which is in fluid communication with only one of the individual pie-shaped flow paths.

Figure 3:
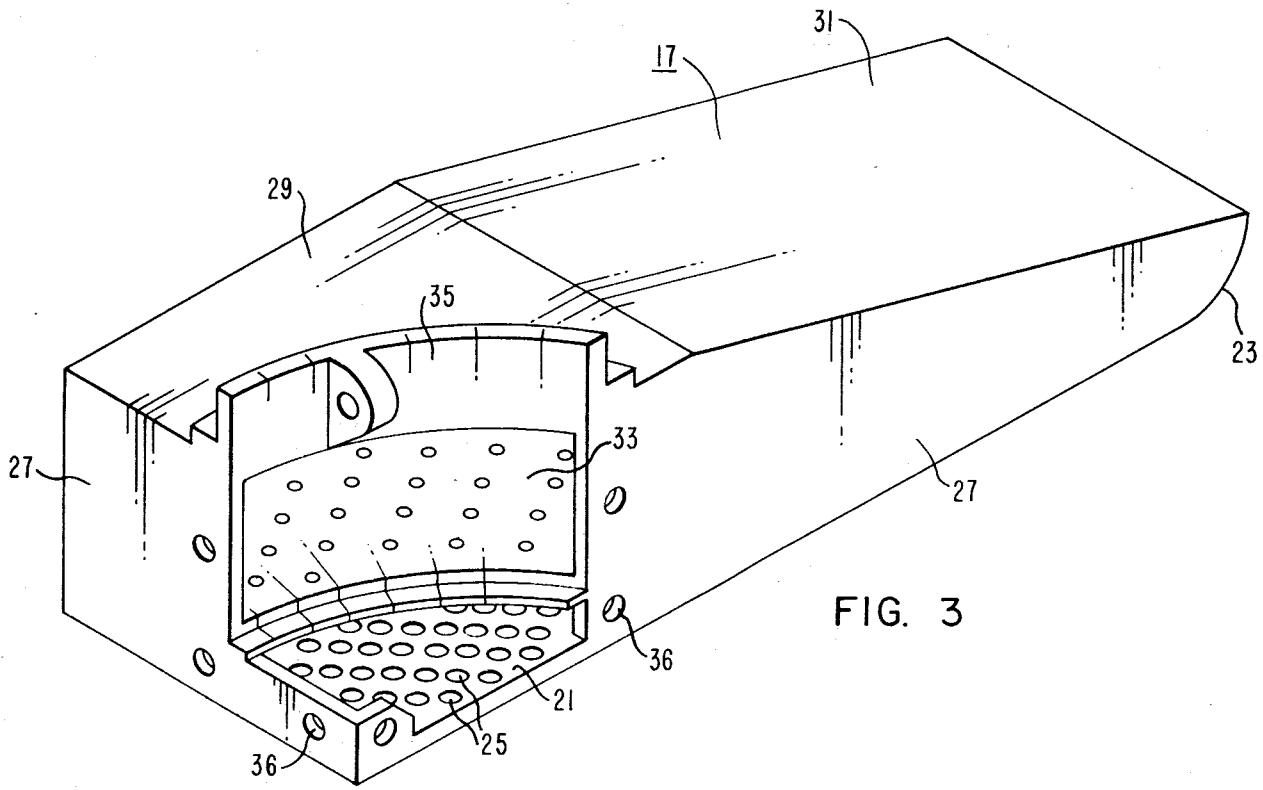
FIG. 3 is an isometric view of a portion of the flow distributor.
Figure 4:
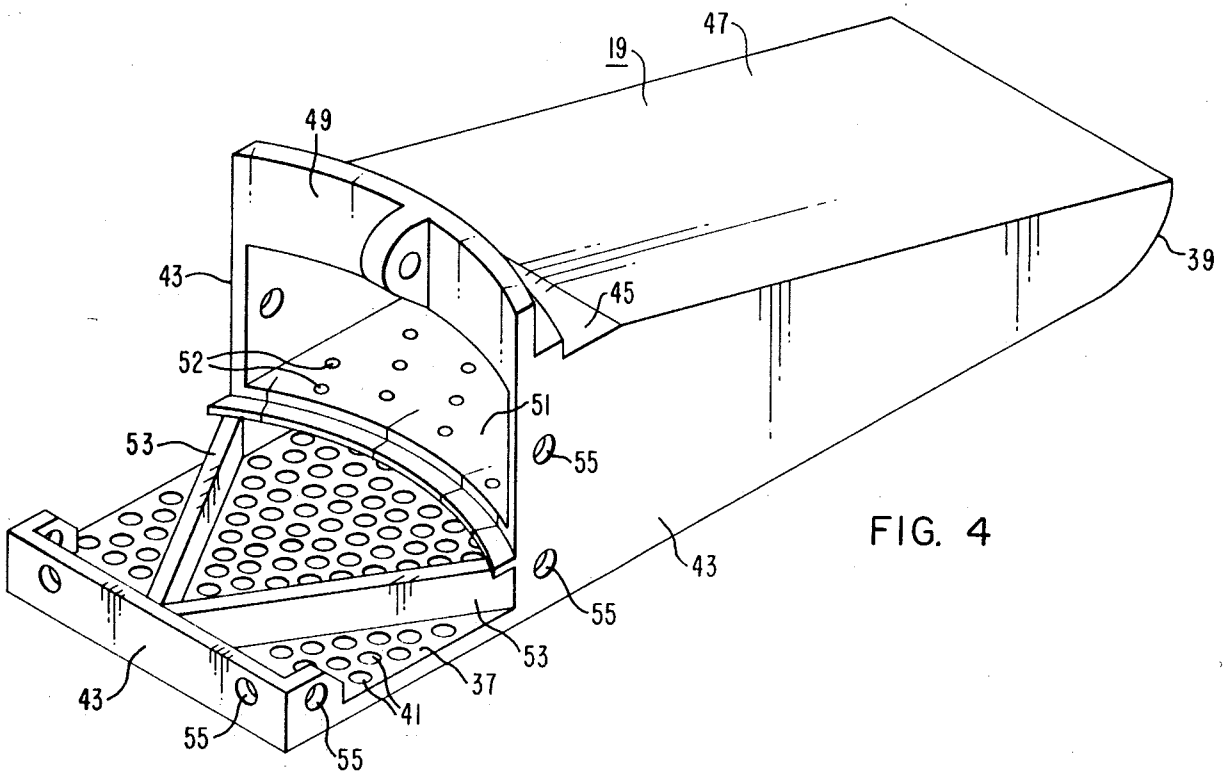
FIG. 4 is an isometric view of another portion of the flow distributor.

The six chambers or enclosures generally have two shapes, end chambers 17, as shown in FIG. 3, and center chambers 19, as shown in FIG. 4. There are four end chambers 17, however, two of these are mirror images of, or opposite hand from, those shown in FIG. 3 and the two center chambers 19 are identical.

Referring now to FIG. 3 the end chambers 17 comprise a plurality of plates joined together and sealed at their margins by welding or other means. A bottom plate 21 is generally flat along its length execpt one end which is bent upward so as to provide a large radius bend 23. The bottom plate 21 is perforated or has a plurality of apertures 25 disposed therein. The enclosures 17 have walls 27 generally normal to the bottom plate 21 on three sides and a top plate 29 generally parallel to the bottom plate 21. The top plate 29 is substantially shorter than the bottom plate 21 and there is an inclined plate 31 which extends from the turned-up margin of the bottom plate 21 to the top plate 29, all of these plates except the bottom plate 21 are imperforate. A perforated plate 33 is disposed within the chamber 17 generally parallel to the bottom plate 21 and spaced therefrom. The perforations in the perforated plate 33 are offset with respect to the perforations in the bottom plate 21 and produce a higher hydraulic resistance to flow than the perforationsin the bottom plate 21.

One corner of the chamber 17 is open forming a pie-shaped opening when looking down from the top plate 29. An arcuate collar 35 is disposed on the top plate adjacent said pie-shaped opening. The perforated plate 33 has such an opening but the bottom 21 does not. The walls 27 adjacent the opening have holes 36 disposed therein for receiving bolts or other fasteners to fasten adjacent chambers together. The width and height of the chambers are sufficiently small to allow the chambers 17 to be placed in the shell through the inlet nozzle 7, however the length of the bottom plate 21 is substantially longer then the diameter of the inlet nozzle 7 and its width is only slightly smaller than the diameter so each chamber distributes the influent fluid over a greater area than the projection of the inlet nozzle 7.

Referring now to FIG. 4 there is shown a center chamber 19 comprising a plurality of plates joined together and sealed at their margins by welding or other means. A bottom plate 37 is generally flat along its length except one end which is bent upwardly so as to provide a large radius bend 39 and it is generally the same shape as the bottom plate 21. The bottom plate 37 also has perforations or apertures 41 spaced at regular intervals therein. Imperforate walls 43 attach to the bottom plate and generally extend normal thereto. A short top plate 45 is disposed generally parallel to the bottom plate and is connected to an inclined plate wall portion 47 which extends to the turned-up margin of the bottom plate 37.

The top plate 49 has a circular margin from which a collar 49 extends. A perforated plate 51 is disposed within the chamber 19 generally parallel to the bottom plate 37. Perforations 52 in the perforated plate 51 are offset with respect to the perforations 41 in the bottom plate 37 and produce a higher hydraulic resistance to flow than the bottom perforated plate 37.

A pair of flat bars 53 extend from the bottom plate 37 to the elevation of the perforated plate 51 forming a V and a pie-shaped opening in the space between the bottom plate 37 and the perforated plate 51. Holes 55 are disposed in the walls 43 for fastening the chambers 19 to the chambers 17 utilizing bolts and nuts or other fasteners.

Figure 5:
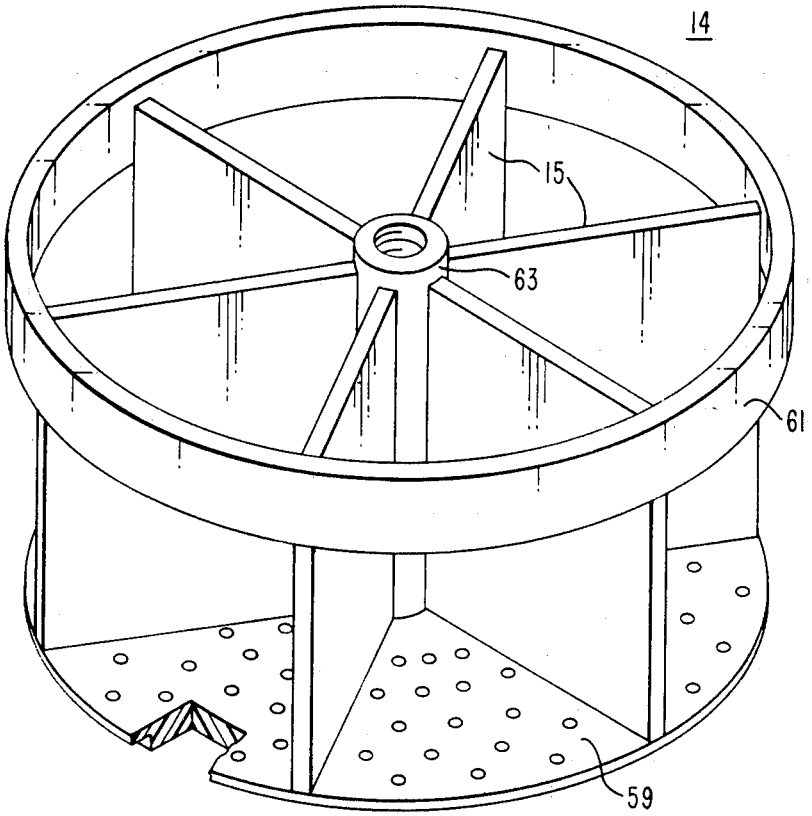
FIG. 5 is an isometric view of a flow splitter for the flow distributor.

FIG. 5 shows the flow splitter 14 which comprises a plurality of radially disposed vanes 15 disposed in a circular array to form a separate flow path for each chamber 17 or 19. A circular perforated plate 59 is disposed on one end of the vanes 57 and a ring 61 is disposed adjacent the opposite end of the vanes 15. A round bar 63 is disposed at the center of the vanes 15 providing a heavy segment to which the vanes 57 can be welded and the round bar 63 is drilled and tapped to provide an attachment for handling the flow splitter and assembled flow distributor.

The method of installing the flow distributor 13 through the inlet nozzle 7 of the shell and tube heat exchanger comprises the steps of:

passing a first end chamber 17 through the inlet nozzle 7 and placing the end chamber 17 in the shell of the heat exchanger so that the chamber 17 is disposed on one side and below the nozzle 7 with the apex of the pie-shaped opening oriented toward the axis of the inlet nozzle 7;

passing a second end chamber 17, opposite hand from that of the first chamber 17, through the inlet nozzle 7 and placing the second end chamber 17 in the shell of the heat exchanger so that the second end chamber 17 is disposed on the other side and below the inlet nozzle 7 with the apex of the pie-shaped opening oriented toward the axis of the inlet nozzle 7;

joining the first and second enclosures 17 so that the pie-shaped openings are adjacent each other by placing bolts and nuts or other fasteners in the registering holes 36;

placing a third end enclosure 17 through the inlet nozzle 7 and placing the third end enclosure 17 on one side of the inlet nozzle 7 above the other end enclosure 17 of opposite hand and placing the third end enclosure 17 in the heat exchanger so that the apex of the pie-shaped opening is oriented toward the axis of the inlet nozzle 7;

placing a fourth end closure 17 through the inlet nozzle 7 and placing the fourth end enclosure 17 on one side of the nozzle and above the end enclosure 17 of opposite hand in such a manner that the apex of the pie-shaped opening is oriented toward the axis of the inlet nozzle 7;

joining the third and fourth end enclosures 17 so that their pie-shaped openings are adjacent each other and fastening them together utilizing bolts and nuts disposed in the registering holes 36;

raising the third and fourth end enclosures 17;

placing a fifth enclosure, a center enclosure 19 through the inlet nozzle 7 of the heat exchanger and placing the fifth enclosure 19 between the end enclosures 17 so that the apex of the pie-shaped opening is oriented toward the axis of the inlet nozzle;

placing a sixth enclosure, another center enclosure 19 through the inlet nozzle 7 of the heat exchanger and placing it on the other side of the nozzle 7 so that the sixth enclosure 19 is disposed between the end enclosure 17 in such a way that the apex of the pie-shaped opening is oriented toward the axis of the inlet nozzle 7;

fastening the enclosures 17 and 19 utilizing the holes 36 and 55 through which bolts or other fasteners are passed to form an assembly with a large rectangular shaped flow path substantially larger than the inlet nozzle;

placing the flow splitter 14 in the inlet nozzle 7 and into the opening in the assembled enclosures 17 and 19 and aligning the vanes 15 with the pie-shaped openings in each chamber 17 or 19;

fastening the flow splitter 14 to the chambers 17 and 19 by welding or other means and lifting the assembly of enclosures 17 and 19 so that the apex of the pie-shaped opening therein is generally coincident with the axis of the inlet nozzle 7;

pulling the assembly of enclosures 17 and 19 into the nozzle a predetermined distance, the arcuate collars 35 and 49 cooperating to form a ring which fits into the nozzle 7;

aligning the assembly of enclosures 17 and 19 so the juncture between enclosures placed on opposite sides of the nozzle 7 is generally vertically oriented;

fastening the assembly of enclosures 17 and 19 in place by welding the ring formed by the collars 35 and 49 to the thermal liner 9 within the inlet nozzle 7;

welding the flow splitter 14 in place within the inlet nozzle to provide a very large compartmented flow distributor 13 within the shell to provide separate flow paths for each chamber 17 and 19.

The flow distributor 13 and method of installing it through the inlet nozzle 7 provides a feedwater flow pattern which reduces peak velocities and controls the direction of the flow into the heat exchanger so as to reduce tube vibration and potential localized tube wall thinning at support plate locations adjacent the inlet nozzle 7.

What is claimed is:

1. A flow distributor for an inlet nozzle of a shell and tube heat exchanger, said flow distributor comprising a plurality of vanes disposed in said inlet nozzle and radially with respect to the axis thereof so as to form a plurality of separate parallel fluid flow paths within said inlet nozzle, a plurality of enclosures separate from said shell, disposed within said shell, and connected to said vanes so that each separate parallel fluid flow path formed in said inlet nozzle is in communication with a separate enclosure, each enclosure having a plurality of apertures disposed in at least one wall of said enclosure in fluid communication with the shell portion of the heat exchanger and being disposed so that said apertures are directly adjacent said tubes the flow distributor being bigger than the inlet nozzle and the enclosures being separate and sized to fit through the nozzle whereby when within the heat exchanger the fluid emitting from said apertures in the flow distributor flows directly on the tubes.

2. A flow distributor as set forth in claim 1, wherein the apertures in each enclosure are distributed over an area substantially larger than the cross-sectional area of the parallel fluid flow paths.

3. A flow distributor as set forth in claim 1, wherein each enclosure has a perforated plate disposed between the fluid flow paths and the apertures, said perforated plate being generally a constant distance from the wall having the apertures and generally coextensive therewith.

4. A flow distributor as set forth in claim 1, wherein the enclosures fit together to form a large compartmented flow distributor disposed within the shell.

5. A flow distributor as set forth in claim 3, wherein the perforated plate has a higher hydrostatic resistance to flow than the apertures in the enclosure.

6. The flow distributor as set forth in claim 3, wherein the perforations in the perforated plate are offset with respect to the apertures.

7. The flow distributor as set forth in claim 1, wherein the flow distributor has six enclosures arranged in a generally rectangular pattern and the vanes are disposed in a circular array forming six pie-shaped paths.

8. A flow distributor as set forth in claim 7 wherein each enclosure has a pie-shaped opening which registers with the pie-shaped flow path.

* * * * *